US006439965B1

(12) United States Patent
Ichino et al.

(10) Patent No.: US 6,439,965 B1
(45) Date of Patent: Aug. 27, 2002

(54) POLISHING PAD AND SURFACE POLISHING METHOD

(75) Inventors: Mitsuyoshi Ichino; Koji Nakamura, both of Yamanashi; Yoshiaki Ishizawa, Nagano; Yasushi Ito, Yamanashi; Takahiro Shimobayashi, Yamanashi; Gosuke Ikemori, Yamanashi; Yuichiro Fujisawa, Yamanashi, all of (JP)

(73) Assignee: Fuji Electric Co., Ltd. (JP)

( * ) Notice: Subject to any disclaimer, the term of this patent is extended or adjusted under 35 U.S.C. 154(b) by 65 days.

(21) Appl. No.: 09/651,637

(22) Filed: Aug. 30, 2000

(30) Foreign Application Priority Data

Aug. 30, 1999 (JP) ..... 11-243620

(51) Int. Cl.[7] ..... B24B 1/00; B24B 47/02

(52) U.S. Cl. ..... 451/36; 451/59; 451/533; 451/550

(58) Field of Search ..... 451/36, 41, 57, 451/59, 65, 533, 534, 538, 539, 550; 51/296, 297, 298, 300

(56) References Cited

U.S. PATENT DOCUMENTS 4,631,220 A * 12/1986 Clifton ..... 428/133
5,564,965 A * 10/1996 Tanaka et al. ..... 451/285
5,807,161 A * 9/1998 Manor et al. ..... 451/442
5,871,393 A * 2/1999 Shiozawa ..... 451/285
6,190,746 B1 * 2/2001 Ishii et al. ..... 428/355 R
6,267,659 B1 * 7/2001 Chen et al. ..... 451/287
6,306,021 B1 * 10/2001 Masumura et al. ..... 451/287
6,312,558 B2 * 11/2001 Moore ..... 156/345

* cited by examiner

*Primary Examiner*—Timothy V. Eley
(74) *Attorney, Agent, or Firm*—Rossi & Associates

(57) ABSTRACT

A workpiece is pinched from above and below by polishing pads attached to the inner surfaces of a pair of upper and lower rotary platens. A slurry is dropped between the workpiece and the polishing pads to polish the workpiece. The polishing pad is comprised of a base layer, and a sheet-shaped nap layer, which is laminated on the base layer and is made of a soft plastic foam. The nap layer is formed of closed pores, whose surface is covered with non-foaming skin layers and which involves pores (air bubble) in the nap layer without opening the pores in the surface. The polishing pad is used in combination with a colloidal slurry whose abrasive grains are colloidal silica in order to polish a surface of the workpiece.

7 Claims, 3 Drawing Sheets

POLISHING PAD AND SURFACE POLISHING METHOD

BACKGROUND OF THE INVENTION

1. Field of the Invention

The present invention relates to a polishing pad and a surface polishing method, which are suitable for a rotary surface polishing apparatus that polishes a surface of a workpiece such as a disk substrate of a magnetic storage medium for a fixed magnetic disk unit, a silicon wafer for a semiconductor, and liquid crystal glass and the like by a chemo-mehanical-polishing (CMP) method.

2. Description of Related Art

To obtain a flat surface of the disk substrate of the magnetic storage medium, the surface of a disc-shaped substrate made of an aluminum alloy is plated with Ni—P of about 10 $\mu$m, and then both sides of the disk substrate are polished (lapped) before the formation of a magnetic layer. Likewise, the flat surfaces of the silicon wafer and the liquid crystal glass and the like are obtained by polishing both sides of their substrates.

On the other hand, a rotary surface polishing machine for polishing the disk substrate, the silicon wafer and the like is widely used which comprises a pair of upper and lower platens, polishing pads attached to the inner surfaces of the platens, and a carrier that is mounted between the upper and lower platens to hold the workpiece. The workpieces, which are inserted into set holes formed in the carrier, are pinched by the polishing pads attached to the platens from above and below. In this state, a slurry is dropped between the polishing pads and the workpiece from the direction of the upper platen while the upper and lower sides of the workpiece are simultaneously polished by rotating the upper and lower platens and the carrier.

Next, there will be described the structure of the rotary surface polishing machine (lapping machine) and the polishing operation with reference to FIGS. 4 through 6. In FIGS. 4(*a*), 4(*b*) and FIG. 5, reference numeral 1 denotes an upper platen; 2, a lower platen; 3, a carrier mounted between the upper platen 1 and the lower platen 2; 4, a workpiece (e.g., the disk substrate and the silicon wafer and the like) to be polished; and 5, polishing pads attached to the inner surfaces of the upper and lower platens 1 and 2.

As shown in the drawing, the carrier 3 is constructed as a planetary gear that rotates and revolves a disc 3*a* through a gear mechanism 3*b*. A plurality of set holes are formed in the disc 3*a* (four set holes are formed in FIG. 4(*b*)), and the workpieces 4 are inserted into the set holes one by one.

With this arrangement, the workpieces 4, which are inserted one by one into the set holes formed in the disc 3*a* of the carrier 3, are pinched by the polishing pads 5 attached to the inner surfaces of the platens 1 and 2 from above and below. In this state, a slurry 6 is dropped through a slurry supply hole 1*a* formed in the upper platen 1 while the upper and lower platens 2 are rotated in reverse directions with the rotation and revolution of each carrier. Therefore, the workpiece 4 as well as the carrier 3 moves on a plane between the upper and lower platens 1 and 2, and the upper and lower sides of the workpiece 4 are polished by the polishing pads 5 and the slurry 6. In the prior art, the slurry 6 is ordinarily produced by finely crushing a hard solid matter composed mainly of metal oxide and carbon by a mill or the like, and dispersing the classified fine powder with a predetermined grain size as abrasive grains in a chemical with an etching function.

On the other hand, the polishing pads 5 are now ordinarily made of soft plastic foam. As shown in a conceptual drawing of FIG. 6, the polishing pads 5 are conventionally structured in such a manner that a nap layer 5*b* made of plastic foam is deposited on a sheet-shaped base layer 5*a*. A honeycomb pore structure is constructed in the nap layer 5*b* in the following manner. Polyethylene, polyurethane resin, and the like are foamed and spread in the shape of a sheet, and skin layers (non-foaming layers which form the surface of the plastic foam) which form the surface of the nap layer 5*b* are buffed to horizontally cut pores (foam) 5*b*-1 in the layer. This forms pore cavities in the surface of the nap layer 5*b*.

In the polishing pads 5 with the above-mentioned structure, the nap layer 5*b* rubbing the workpiece 4 has an uneven surface having the honeycomb pore structure. Crater-shaped cavities of the pores 5*b*-1 hold the slurry 6 dropped from the outside during the polishing. As shown in FIG. 6, when the workpiece 4 moves relatively to the upper and lower polishing pads 5, the slurry held in the pores is squeezed out to polish the surface of the workpiece 4. The sludge deposited with the progress of the polishing and other mixed alien matters are captured into and held in the cavities of the pores 5*b*-1 in order to prevent the surface of the workpiece from being scratched and the like.

The above-mentioned method, in which the workpiece is polished by a combination of the polishing pads and the slurry with the conventional structure, has the following problems to be solved:

1) As shown in the conceptual drawing of FIG. 6, the surface of the nap layer 5*b* made of the plastic foam in the conventional polishing pad 5 is uneven, and only cut parts of a wall surrounding the pores 5*b*-1 locally contact with and slide on the workpiece 4 during the polishing. Thus, the polishing pads 5 cannot uniformly contact with the entire surface of the workpiece 4. Therefore, the workpiece 4 cannot be polished uniformly, and this results in a fine "waviness" on the polished surface of the workpiece 4. It is therefore difficult to ensure a surface quality required by a product specification. The "waviness" as well as "surface roughness" is an item to be measured for evaluating the surface quality with respect to the disk substrate, the silicon wafer and the like. The "waviness" is represented by a waving amount (Wa) of a surface image per unit area observed by an optical non-contact surface roughness gauge (ZYGO) in an angstrom (Å). Particularly, if the "waviness" is increased on the disk substrate for use in the fixed magnetic disk unit used in combination with a floating magnetic head, a floating characteristic of the magnetic head is deteriorated. It is therefore important to reduce the "waviness" as much as possible during the polishing.

2) The abrasive grains of micro powder (whose particles have square surfaces) obtained by crushing and classifying a solid matter as mentioned previously are ordinarily mixed in the conventional slurry 6. The abrasive grains, the sludge and the like easily sediment and agglutinate in the slurry of this kind. If this slurry is used in combination with the conventional polishing pads 5 described with reference to FIG. 6, the alien matters such as the abrasive grains and the sludge in the slurry are caked in the pores 5*b*-1 formed in the surface of the nap layer 5*b* during the polishing although a large amount of slurry can be held on the polishing pads. If the caked alien matters are left as they are, they may rub the surface of the workpiece during the polishing to thereby form scratches, which may cause troubles. Therefore, in the prior art, a brush, a jet stream or the like frequently cleans the surfaces of the polishing pads 5 in a short cycle in order to remove the alien matters (caked matters) adhered to the polishing pads. This maintaining (cleaning) operation, however, requires a lot of time and effort, and it is necessary to stop running the polishing machine during the maintaining operation. This affects the operating rate of the polishing machine.

3) The conventional polishing pad has much unevenness in the nap layer thereof after the manufacture. In order to polish a product mounted on the surface polishing machine, a running-in is performed in advance to fair the surface of the polishing pad by polishing a dummy workpiece. The running-in requires a lot of time, which is one of the causes of the decrease in the operating rate of the polishing machine.

4) Recently, a colloidal slurry has been mainly used as the slurry in order to improve the polishing accuracy, prevent the abrasive grains from caking, and improve the maintainability of the polishing pads. The use of the colloidal slurry in combination with the conventional polishing pads, however, results in the polishing unevenness and the fine "waviness", and it is difficult to make full use of the characteristics owned by the colloidal slurry.

It is therefore an object of the present invention to provide a polishing pad and a surface polishing method, which are improved so as to increase the workpiece polishing accuracy and uniformly polish the surface of the workpiece particularly in combination with a colloidal slurry.

SUMMARY OF THE INVENTION

The above object can be accomplished by providing a polishing pad which comprises a base layer and a sheet-shaped nap layer laminated on the base layer and made of soft plastic foam, the polishing pad wherein: the nap layer is formed of closed pores, whose surfaces are covered with skin layers and whose pores are involved and closed within the nap layer.

In a preferred mode of the present invention, a flat surface of the nap layer is obtained by buffing external surfaces of the skin layers in the closed pores forming the nap layer to such an extent as not to open the pores involved in the nap layer.

In another preferred mode of the present invention, the base layer is made of high hardness resin.

In yet another preferred mode of the present invention, the base layer is a non-woven fabric made of synthetic fiber.

In yet another preferred mode of the present invention, the base layer is a woven fabric made of synthetic fiber.

The polishing pad of the present invention is more advantageous in view of functions and maintenance compared with the conventional polishing pad in which pores (air bubbles) of a plastic foam are opened in the surface. The advantages are as follows.

a) A skin layer of a plastic foam forming the nap layer of the polishing pad directly contacts with the whole surface of the polished surface of the workpiece to polish the workpiece, and the foaming pores involved in the layer serve as a cushion. Thus, the surface of the workpiece can be polished with a substantially constant polished surface pressure, and this prevents the polishing unevenness and the "waviness" on the surface of the workpiece, which are the problems of the polishing with the conventional polishing pads. Therefore, the workpiece can be polished with an excellent surface quality. Moreover, the slurry supplied to the surface of the polishing pad spreads over the whole surface of the workpiece to polish the workpiece, and this achieves a high polishing performance.

b) The slurry dropped from the outside during the polishing flows to the outside of a system after flowing between the workpiece and the surfaces of the skin layers in the polishing pads. Thus, alien matters such as sludge can be quickly discharged to the outside of the system in company with the slurry without being adhered to or remaining on the polishing pads. This prevents the formation of defects such as scratches in the surface of the workpiece, which results from the caking of the sludge adhered to the polishing pads. Moreover, the frequency of cleaning the polishing pads can be decreased, so that the polishing pads can be used continuously for a long period of time without maintenance.

c) The whole surfaces of the polishing pads are covered with the flat skin layers of the closed pores, and thus, the running-in performed initially can be shortened. This enables a quick setup of the polishing machine, and improves the operating rate of the polishing machine.

On the other hand, in a surface polishing method of the present invention, the polishing pad that is constructed in the above-mentioned manner is attached to platens of the surface polishing machine, and the workpiece is polished by using a colloidal slurry. The colloidal slurry is obtained by dispersing micro powder of colloidal silica as abrasive grains in a dispersion medium.

The colloidal silica is produced by a chemical process, and is different from those produced by mechanically crushing a solid matter by a mill or the like. The colloidal silica is a hard micro powder, whose grain size is 0.02–0.1 $\mu$m and which has a flat surface. The colloidal slurry, in which the colloidal silica as abrasive grains are dispersed in the dispersion medium, has a high dispersiveness, and thus, the abrasive grains are not easily caked. There is little possibility that the abrasive grains are caked to cause defects such as scratches in the surface of the workpiece during the polishing. Thus, the use of the colloidal slurry in combination with the polishing pads of the present invention achieves a high polishing performance and an excellent surface quality since the characteristics of the colloidal slurry are made full use of.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENT

Figure 5:
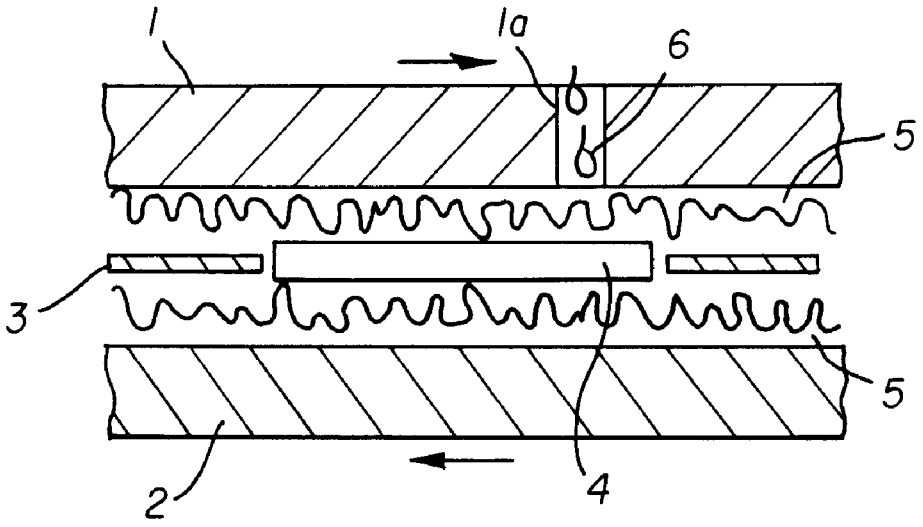
FIG. 5 is an enlarged view of principal parts of FIG. 4.
Figure 6:
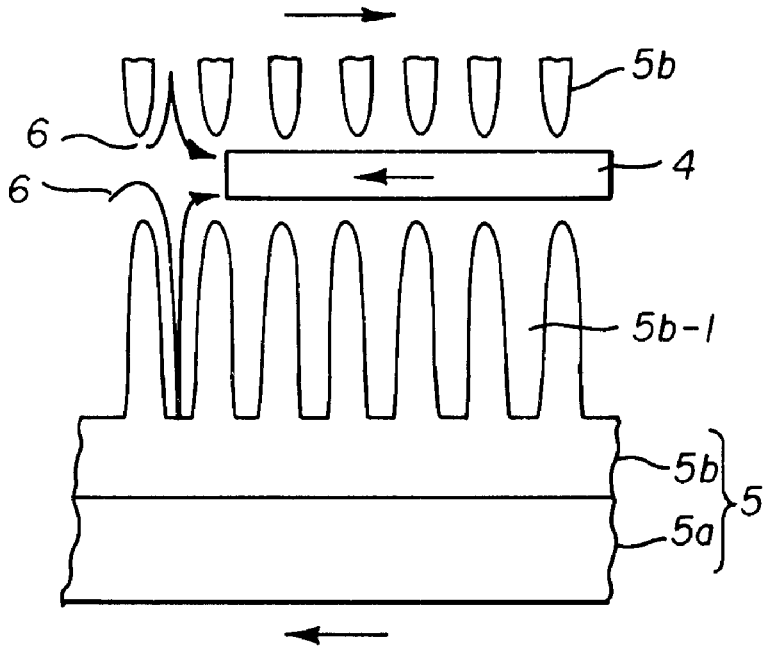
FIG. 6 is an enlarged view conceptually showing the structure of polishing pads and the behavior of a slurry in a prior art.

A preferred embodiment of the present invention will be described hereinbelow with reference to FIGS. 1–3. In the following description, members corresponding to those described with reference to FIGS. 5 and 6 are denoted by the same reference numerals, and they will not be described in detail.

Figure 1:
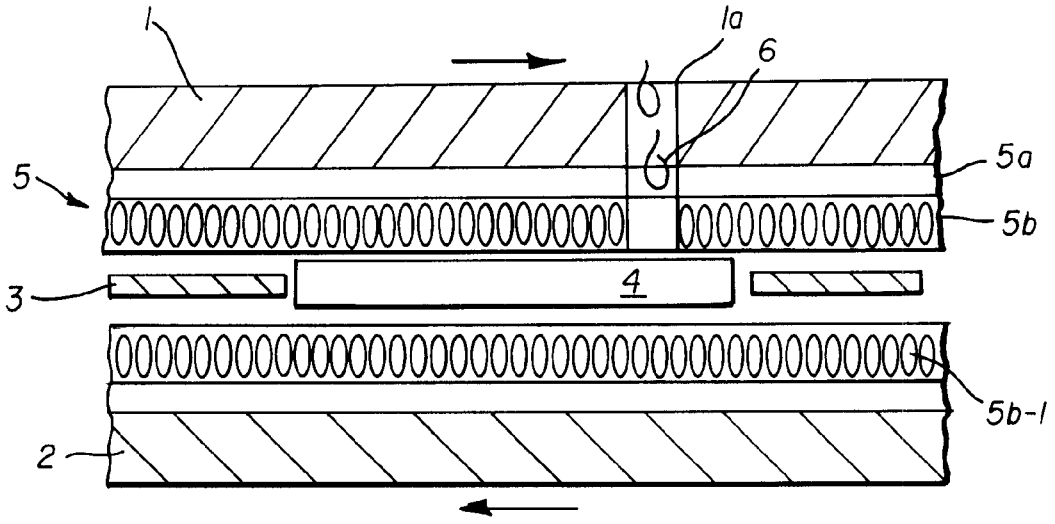
FIG. 1 is a cross-sectional view showing the state wherein a surface polishing machine, to which polishing pads of the present invention are attached, polishes a workpiece.
Figure 2:
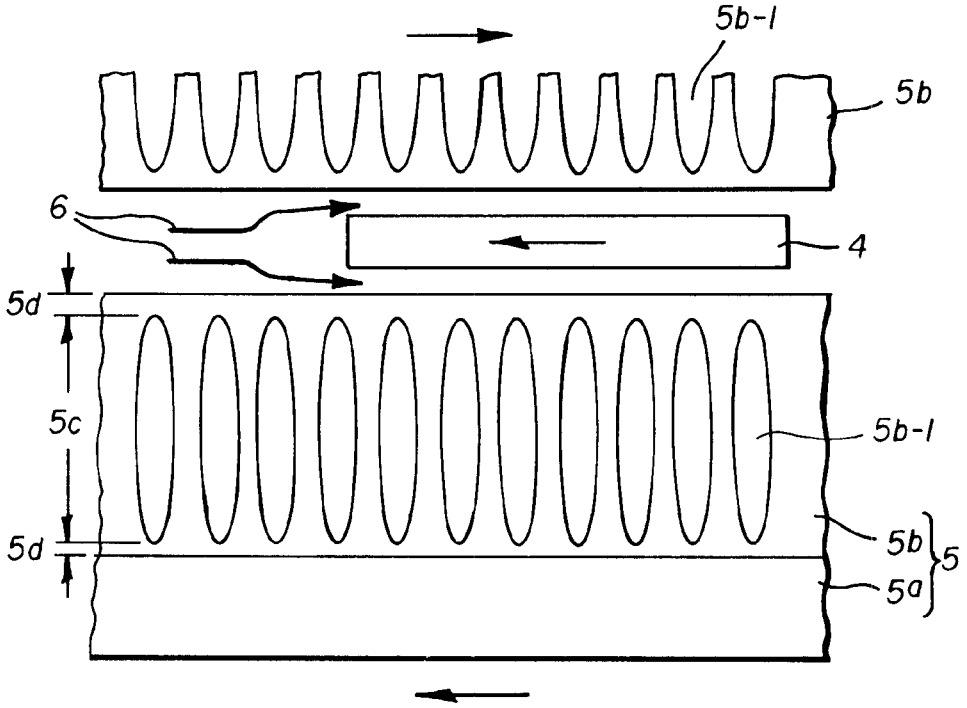
FIG. 2 is an enlarged cross-sectional view conceptually showing the structure of the polishing pad in FIG. 1.

As shown in FIGS. 1 and 2, sheet-like polishing pads 5 are attached to upper and lower platens 1 and 2 of a surface polishing machine. Each polishing pad 5 is constructed in such a manner that a nap layer 5*b* of closed plastic pores is attached to a sheet-shaped base layer 5*a* made of high hardness resin such as polyethylenie terephthalete (PETr) or synthetic fiber woven fabric or non-woven fabric.

The closed pores, which form the nap layer 5*b*, are produced by foaming resin such as polyethylene and polyurethane and developing the foamed resin in the shape of a sheet. As shown in the conceptual view of FIG. 2, the closed pores have the same structure as a structural foam in which non-foaming skin layers 5*d* are formed at both sides of a core layer 5*c* involving pores (air bubbles) 5*b*-1, which are foamed uniformly. The pores 5*b*-1 are closed in the core layer 5*c*, and the skin layers 5*d* are exposed in surfaces facing to a workpiece 4. The skin layers 5*d* are laminated on the base layer 5*b* to construct the polishing pad 5. If a surface flatness of the nap layer 5*b* is low after the formation, the surface of the skin layers 5*d* are buffed to obtain a flat surface to such an extent as not to open the pores 5*b*-1 in the state wherein the nap layer 5*b* is laminated on the base layer 5*a*.

In order to attach the polishing pad 5 with the above-mentioned structure to the surface polishing machine, the base layers 5*a* are attached to the internal surfaces of the upper and lower platens 1 and 2 with the skin layers 5*d* of the nap layers 5*b* facing to the workpiece 4 as shown in FIG. 1. Then, the workpiece 4 is loaded on a carrier 3 of the polishing machine as shown in FIG. 1, and a slurry 6 is dropped to polish the surface of the workpiece 4 while the upper and lower platens 1 and 2 are rotating in reverse directions.

In the polishing, the flat skin layers 5*d* made of the plastic foam forming the nap layers 5*b* of the polishing pads 5 apply a uniform polishing surface pressure to the whole polished surface of the workpiece 4. Meanwhile, the slurry 6 flows along the surface of the skin layers 5*d* to polish the surface of the workpiece 4, thus obtaining a flat surface as shown in FIG. 2.

Figure 3:
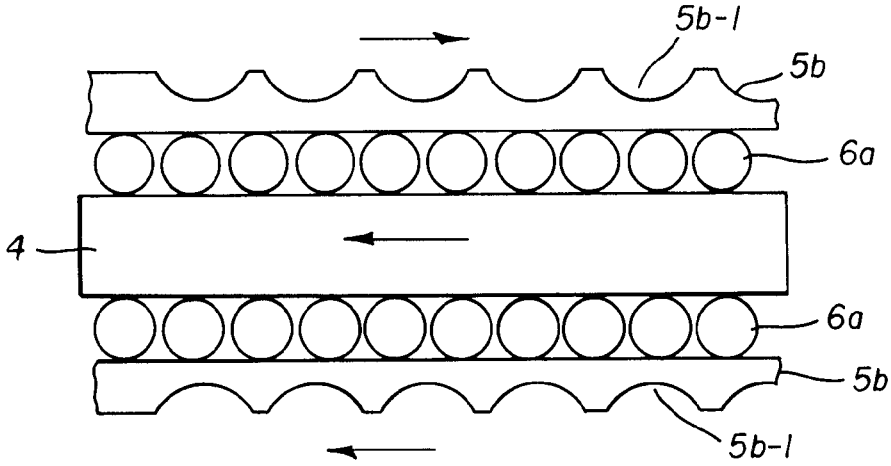
FIG. 3 is an explanation drawing conceptually showing a surface polishing method of the present invention, in which a workpiece is polished by using a colloidal slurry in combination with the polishing pads in FIG. 1.
Figure 4A:
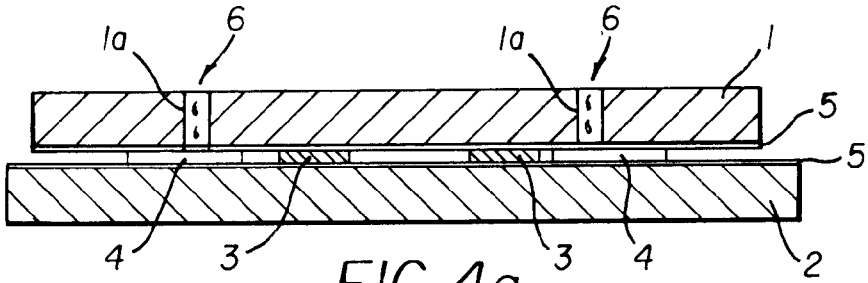
FIG. 4 is a view showing the principle of the structure of a surface polishing machine to which the present invention is applied, wherein FIG. 4(*a*) is a cross-sectional view, and FIG. 4(*b*) is a plan view of a carrier.
Figure 4B:
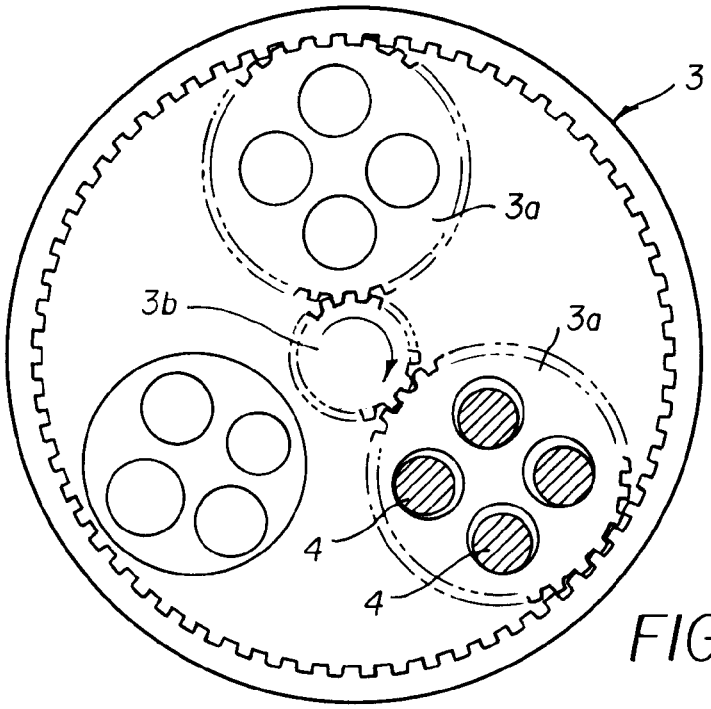

FIG. 3 is a conceptual drawing showing the state wherein a colloidal slurry, whose abrasive grains of fine powder of colloidal silica 6*a* are dispersed in a dispersion medium, is used in combination with the polishing pads 5 to polish the workpiece 4. As shown in FIG. 3, the spherical abrasive grains (colloidal silica 6*a*) with uniform sizes are uniformly spread over the whole surface of the workpiece 4 to polish the workpiece 4. The particles of the colloidal silica 6*a* as the abrasive grains do not have square surfaces, and therefore, they smoothly flow between the workpiece 4 and the surfaces of the polishing pads 5 without getting caught in and being adhered to the surfaces of the polishing pads 5.

Therefore, the polishing pads of the present invention can achieve a higher polishing performance without causing the polishing unevenness on the workpiece compared with the conventional abrasive cloth described with reference to FIG. 6. Moreover, the alien matters such as the sludge can be removed to the outside of a system in company with the colloidal slurry without remaining on the surfaces of the polishing pads. This reduces the polishing defects such as scratches in the workpiece and achieves an excellent surface quality.

According to the results of an evaluation test conducted by inventors and others, polishing the workpiece by using the polishing pads of the present invention significantly improves the surface quality of the workpiece compared with the case where the conventional polishing pads are used. Particularly when the polishing pads of the present invention are used in combination with the colloidal slurry to polish the workpiece, the above-mentioned "waviness" (Wa) can be improved to Wa=2 Å compared with a measured value Wa=5 Å of a product polished by the conventional polishing pads.

As set forth hereinabove, polishing the surface of the workpiece by using the polishing pads of the present invention significantly improves the polishing performance and the polished surface quality compared with the case where the conventional abrasive cloth is used. Particularly when the polishing pads of the present invention are used in combination with the colloidal slurry to polish the workpiece, the polishing can achieve an excellent surface quality since the characteristics of the colloidal slurry are made full use of. Moreover, the "waviness", which is one of items to be measured for evaluating the surface quality of the workpiece, can be reduced to half or less compared with the case where the conventional polishing pads are used. Furthermore, the practical effects contributing to the improvement in the operating rate of the polishing machine can be achieved. For example, the frequency of the maintaining operation for cleaning the polishing pads and the period of the running-in prior to the polishing of a product in the actual use of the polishing pads can be reduced.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A polishing pad comprising: a base layer; and a sheet-shaped nap layer laminated on said base layer and made of soft plastic foam, wherein said nap layer is formed of closed pores, the surfaces of said nap layer are covered with skin layers which do not have closed pores, and the closed pores of said nap layer are within said nap layer.

2. A polishing pad according to claim 1, wherein a flat surface of said nap layer is obtained by buffing external surfaces of said skin layers of said nap layer to such an extent as not to open said closed pores within said nap layer.

3. A polishing pad according to claim 1, wherein said base layer is made of high hardness resin.

4. A polishing pad according to claim 1, wherein said base layer is a non-woven fabric made of synthetic fiber.

5. A polishing pad according to claim 1, wherein said base layer is a woven fabric made of synthetic fiber.

6. A surface polishing method comprising the steps of adhering one or more polishing pads according to claim 1 respectively to one or more platen of a surface polishing machine, and polishing a workpiece by using a colloidal slurry and said one or more polishing pads.

7. A surface polishing method according to claim 6, wherein said colloidal slurry is obtained by dispersing micro powder of colloidal silica as abrasive frains in a dispersion medium.

* * * * *